US007021845B2

(12) United States Patent
Kondo

(10) Patent No.: US 7,021,845 B2
(45) Date of Patent: Apr. 4, 2006

(54) TAPE PRINTING DEVICE

(75) Inventor: Hakudai Kondo, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/739,198

(22) Filed: Dec. 19, 2003

(65) Prior Publication Data

US 2004/0131410 A1 Jul. 8, 2004

(30) Foreign Application Priority Data

Dec. 20, 2002 (JP) ..... 2002-369509

(51) Int. Cl.
*B41J 3/36* (2006.01)
*B41J 29/00* (2006.01)

(52) U.S. Cl. ..... 400/88; 400/693

(58) Field of Classification Search ..... 400/613, 400/621, 88

See application file for complete search history.

(56) References Cited

U.S. PATENT DOCUMENTS

| | | | | |
|---|---|---|---|---|
| 4,611,246 | A | 9/1986 | Nihei | 358/472 |
| 5,043,822 | A * | 8/1991 | Ichiyoshi et al. | 348/376 |
| 5,598,082 | A * | 1/1997 | Gilpin et al. | 200/293.1 |
| 5,758,980 | A | 6/1998 | Takenaka | 400/611 |
| 5,839,840 | A | 11/1998 | Kawano | 400/621 |
| 6,394,675 | B1 * | 5/2002 | Sodeyama et al. | 400/615.2 |
| 6,435,744 | B1 | 8/2002 | Dunn et al. | 400/621 |
| 6,503,005 | B1 * | 1/2003 | Cockerill et al. | 400/88 |
| 6,602,009 | B1 * | 8/2003 | Sodeyama | 400/621 |
| 2002/0136584 | A1 * | 9/2002 | McCleave et al. | 400/615.2 |

FOREIGN PATENT DOCUMENTS

| | | | |
|---|---|---|---|
| EP | 0 361 693 A2 | | 4/1990 |
| EP | 0 748 696 A2 | | 12/1996 |
| JP | A 9-254450 | | 9/1997 |
| JP | 2000229448 A | * | 8/2000 |
| JP | 2001322333 A | * | 11/2001 |
| JP | 2001356873 A | * | 12/2001 |

OTHER PUBLICATIONS

Machine translation of JP 2001-356873 to Miyashita from Japanese Patent Office website.*
Machine translation of JP 2001-322333 to Ota from Japanese Patent Office website.*

* cited by examiner

*Primary Examiner*—Daniel J. Colilla
(74) *Attorney, Agent, or Firm*—Oliff & Berridge PLC

(57) ABSTRACT

A tape printing device is provided with a device body. A cassette holding section is formed on one end side portion in the longitudinal direction of the body. A battery holding section is formed on the other end side portion of the device body. A plurality of batteries are accommodated in the battery holding section. At least two batteries are aligned such that the longitudinal direction of the batteries is substantially parallel with the longitudinal direction of the device body. The tape printing device further includes a printing system, and a driving system that feeds a tape-form recording medium. In the tape printing device, the device body has a gripping portion formed on the other end side portion of the device body. The width of the gripping portion of the device body is narrower than the width of the cassette holding section.

25 Claims, 11 Drawing Sheets

TAPE PRINTING DEVICE

BACKGROUND OF THE INVENTION

The present invention relates to a portable tape printing device for printing characters/letters on a tape-form recording medium.

Conventionally, various portable tape printing devices are proposed. An example of the portable tape printing device is configured to have a body in which a tape cassette holding a tape-form recording medium (hereinafter simply referred to as a tape) is accommodated. A platen roller driven by a driving motor powered by batteries is provided in the device. The tape is printed by a printing mechanism and discharged from the device.

U.S. Pat. No. 5,758,980 discloses such a tape printing device. According to the disclosure of the publication, a control circuit board and the tape cassette are arranged inside a case of the tape printing device such that they substantially overlap in the vertical direction, and a cutout portion is formed at one end of the control circuit board in a longitudinal direction thereof. The driving motor is placed in a space defined between the control circuit board and the tape cassette at the cutout portion. Further, a power supply circuit and multiple batteries (e.g., six batteries) are disposed in the case on the opposite side of the driving motor, with the batteries arranged in parallel within a battery holder.

In the above-mentioned arrangement, it is not necessary to form a space, for locating the driving motor, behind the control board and between the tape cassette and the battery holder. With this arrangement, it becomes unnecessary to form the control circuit board to be elongated or the case to be enlarged, and the tape printing device can be formed short and compact. Further, when the driving motor is disposed on one side of a wide portion of the case in the longitudinal direction thereof and the battery holder is formed on the other side, the driving motor and the batteries, both of which are heavy weight parts, are disposed on both sides of the case. As a result, the tape printing device becomes balanced when a person take it in hand for input operation. Thus, the operability of the tape printing device is improved.

Further, by providing a liquid crystal display (LCD) on a wide surface of the control circuit board at a location nearer to a short side thereof, and locating the cutout portion, at which the driving motor is to be disposed, beside the LCD, the size of the control board in the longitudinal direction can be reduced, resulting in shorter size of the case of the tape printing device in the longitudinal direction. Thus, the whole tape printing device can be made compact.

In the conventional tape printing device described above, the width of the case of the device is relatively wide since the batteries are arranged in parallel with the width direction of the device body, and hence the portion gripped by a hand is also wide, which makes it difficult to hold the device body with one hand. Further, the wide gripping portion of the device body makes it difficult to operate keys such as character input keys by the same hand that holds the tape printing device. That is, in such a device, it is necessary to press the character input keys, for example, by the right hand while holding the tape printing device with the left hand, resulting in bad operability.

SUMMARY OF THE INVENTION

The present invention is advantageous in that the above-mentioned problem can be solved. According to the invention, there is provided an improved tape printing device that is easy to operate, easy to hold with a hand and easy to input printing data by pressing the character input keys or the like with the hand that holds the device.

Further, according to the invention, there is provided a tape printing device in which the tape cassette and the battery holder are arranged such that the tape cassette and a part of the battery holder overlaps in the vertical direction so that the gripping portion can be made in a form easy to hold, and so that the body size of the device in the longitudinal direction can be reduced easily.

According to an aspect of the invention, there is provided a tape printing device, which is provided with a device body having a thickness and extending in a longitudinal direction and in a width direction which is perpendicular to the longitudinal direction, a cassette holding section formed in the device body on one end side portion in the longitudinal direction thereof to accommodate a tape cassette, a printing system that prints characters/letters on a tape-form recording medium accommodated in the tape cassette, a driving system that feeds the tape; and a battery holding section formed in the device body on the other end side portion in the longitudinal direction thereof to accommodate a plurality of batteries, at least two of the plurality of batteries being aligned in the longitudinal direction with the longitudinal direction of the at least two of the plurality of batteries being substantially parallel with the longitudinal direction of the device body. In the tape printing device configured as above, the device body has a gripping portion formed on the other end side portion in the longitudinal direction, the width of the gripping portion of the device body being narrower than the width of the cassette holding section.

According to an embodiment of the invention, the one end side portion is an upper end side portion of the device body when the tape printing device is in use.

Optionally, the tape printing device as above may be configured to include a display device disposed on a surface of the device body at a position corresponding to the cassette holding section, and a print data input system disposed on the device body surface at a portion on the other end side portion in the longitudinal direction of the device body with respect to the display device. In this case, the print data input system may have a plurality of character input keys arranged on a surface of the gripping portion.

Further, each of the character input keys may be configured so that a plurality of characters is input one by one cyclically upon operation of the each of the character input key.

Still optionally, the battery holding section may be formed closer to a one end side, in the width direction, of the device body.

In this case, a first finger clearance, through which a finger is inserted to pick up the batteries, may optionally be formed adjacent to the battery holding section, on the other end side, in the width direction, of the battery holding section.

In a particular case, the first finger clearance does not overlap the cassette holding section.

According to an embodiment, the battery holding section and the print head are located on opposite sides, in the width direction, with respect to a longitudinal center line of the device body.

In this case, the driving device may be disposed, inside the device body, on a front surface side in a thickness direction of the tape cassette, and on the one end side, in the longitudinal direction of the device body, of the battery holding section.

Further, in the above configuration, a first finger clearance, through which a finger is inserted to pick up the batteries, may be formed adjacent to the battery holding section, on a print head side of the battery holding section in the width direction.

Further optionally, at least a part on the one end side, in the longitudinal direction of the device body, of the battery holding section may be configured to overlap at least a part on the other end side of the cassette holding section, in the longitudinal direction of the device body.

Still optionally, a tape discharging opening may be formed on a side surface at the one end side, the tape-form recording medium being discharged through the discharging opening.

Furthermore optionally, each of end sides, in the width direction, of the gripping portion is formed to be a smoothly curved surface such that both corners in a thickness direction thereof are rounded, and a back side surface of the tape printing device is formed such that a thickness gradually decreases from a portion corresponding to the cassette holding section toward a portion corresponding to a part on the one end side, in a longitudinal direction, of the device body of the gripping portion.

Still optionally, the cassette holding section may be formed with second finger clearances at opposite sides along the longitudinal direction of the device body, the second finger clearances allow fingers to grip the tape cassette attached to the cassette holding section.

In this case, one of the second finger clearances formed on the opposite sides of the cassette holder in the longitudinal direction of the device body may be formed to overlap a part, on the one end side, of the battery holding section in a longitudinal direction thereof.

According to another aspect of the invention, there is provided a tape printing device, which is provided with a device body having a thickness and extending in a longitudinal direction and in a width direction which is perpendicular to the longitudinal direction, a cassette accommodating section formed in the device body on one end side portion in the longitudinal direction thereof, and a battery accommodating section formed in the device body on the other end side portion in the longitudinal direction thereof. Further, at least a part of the cassette accommodating section and at least a part of the battery accommodating section overlap in the longitudinal direction of the device body.

Optionally, a width of a portion of the device body corresponding to the battery accommodating section may be smaller than a width of a portion of the device body corresponding to the cassette accommodating section.

Further optionally, a thickness of a portion of the device body corresponding to the battery accommodating section may be smaller than a thickness of a portion of the device body corresponding to the cassette holding section.

In the above cases, a shape of the device body gradually changes from the portion corresponding to the battery accommodating section to the portion corresponding to the cassette accommodating section using a curved surface.

According to an embodiment, one end side portion is an upper end side portion of the device body when the tape printing device is in use.

Still optionally, the battery accommodating section may be formed closer to one end side, in the width direction, of the device body.

In this case, a first finger clearance, through which a finger may be inserted to pick up a battery accommodated in the battery accommodating section, is formed adjacent to the battery accommodating section, on the other end side, in the width direction, of the battery accommodating section.

Further, the first finger clearance may be formed so as not to overlap the cassette accommodating section.

Still optionally, a tape discharging opening may be formed on a side surface at the one end side, a tape-form recording medium accommodated in the cassette being discharged through the discharging opening.

Further optionally, the tape printing device may include a tape cutting mechanism including a lever manually operable by a user, the tape-form recording medium being cut out when the user operates the lever, the lever being provided on a side end surface, in the width direction, of the device body on the one end side portion.

BRIEF DESCRIPTION OF THE ACCOMPANYING DRAWINGS

FIGS. 8 and 8A–8E show a front view of the tape printing device and outline shapes of cross sections at various longitudinal positions;

DETAILED DESCRIPTION OF THE EMBODIMENT

Hereinafter, a tape printing device 1 according to an embodiment of the invention will be described in detail with reference to the accompanying drawings.

First, the general configuration of the tape printing device 1 will be described with reference to FIGS. 1 through 4.

Figure 1:
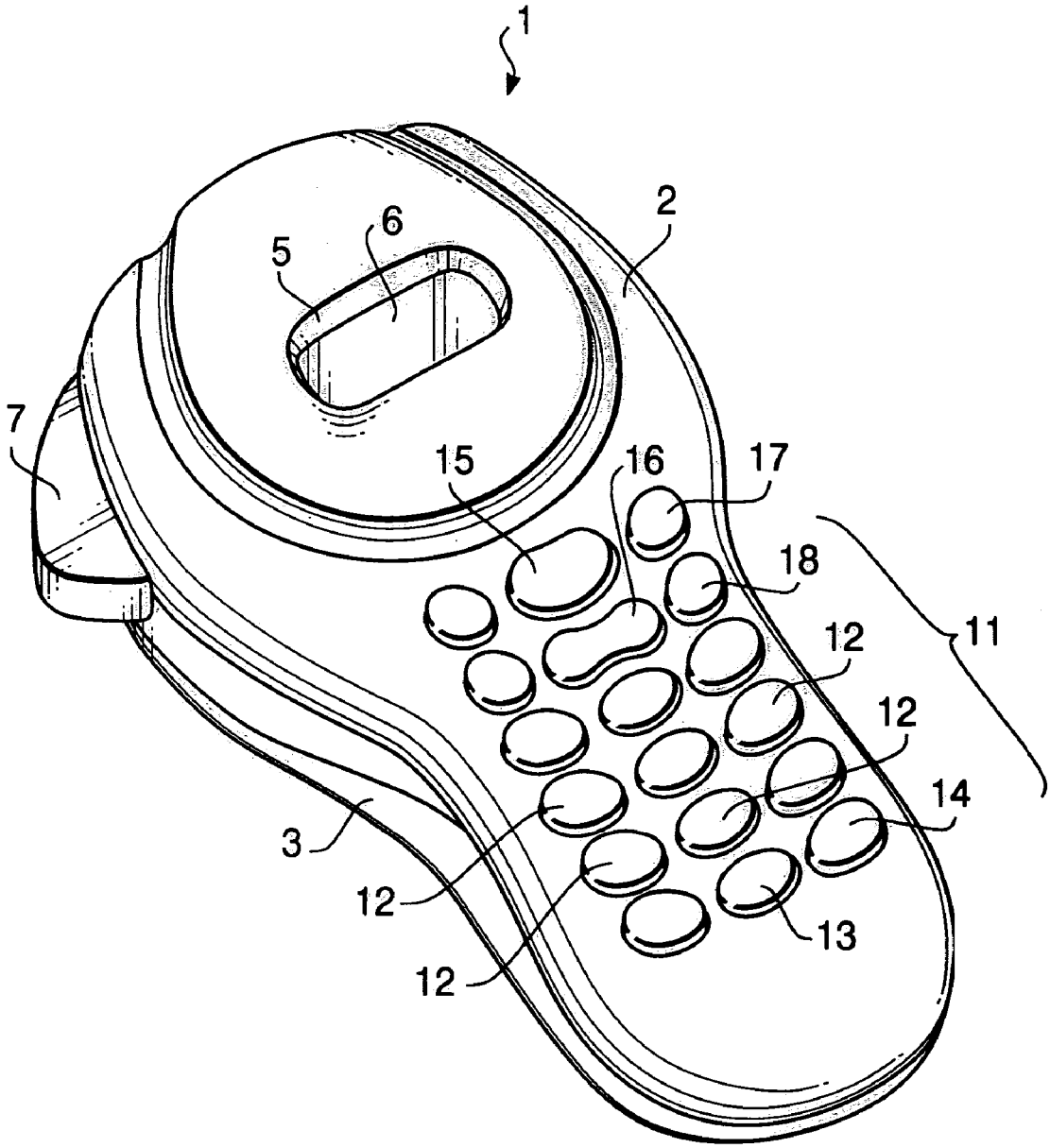
FIG. 1 is a perspective view showing an appearance of a tape printing device according to an embodiment.
Figure 2:
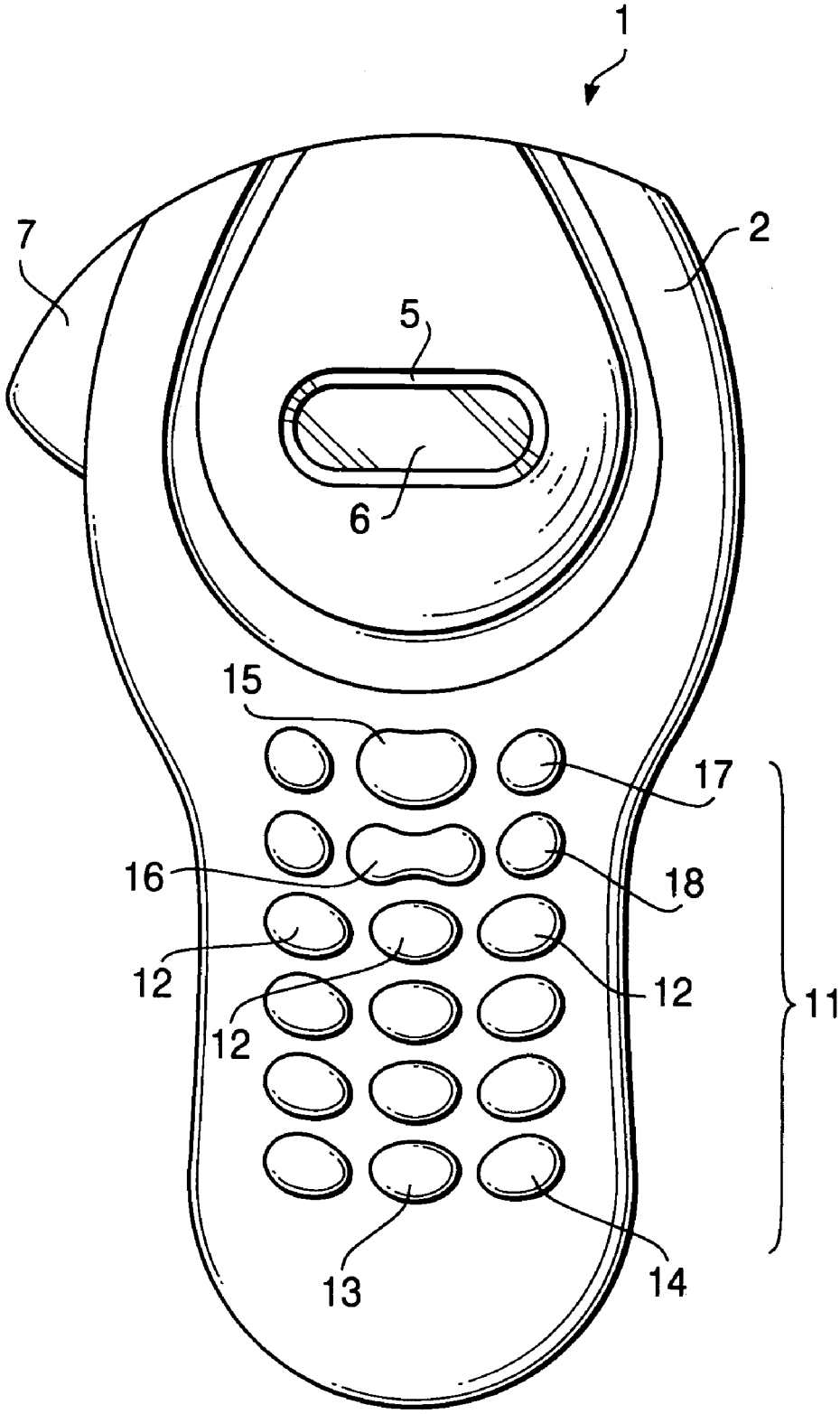
FIG. 2 is a front view of the tape printing device according to the embodiment.
Figure 3:
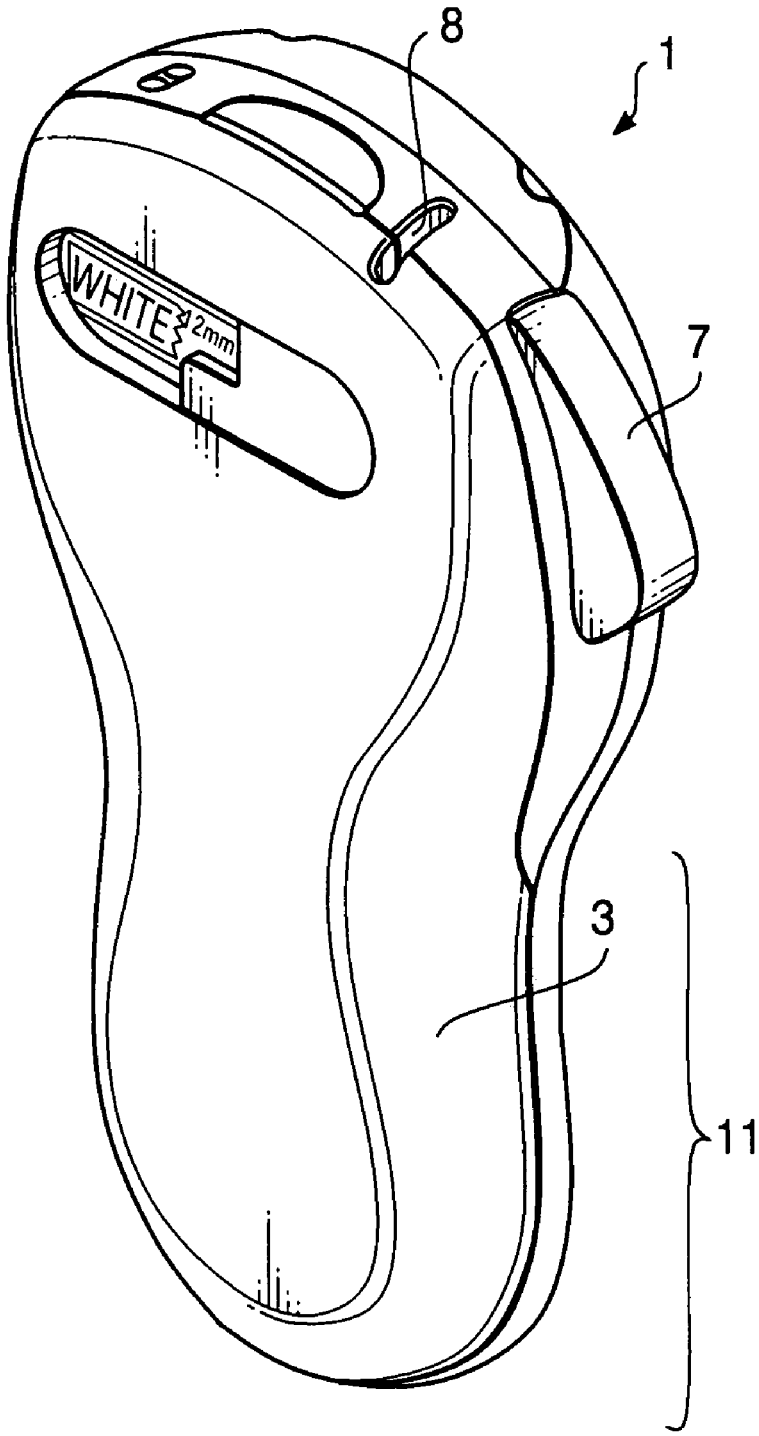
FIG. 3 is a perspective view of the tape printing device according to the embodiment, viewed from an upper-rear direction.

As shown in FIGS. 1 through 4, the tape printing device 1 has a body 2 made of synthetic resin and a back cover 3 made of synthetic resin. The back cover 3 is detachably attached to the body 2 so that it covers the rear side, which is a side opposite to a front side that faces a user using the tape printing device 1, of the body 2. As shown in FIG. 2, the tape printing device 1 is longer in an up and down direction in FIG. 2 than in a width direction (i.e., a right and left direction in FIG. 2). A substantially upper half of the body 2 in the longitudinal direction thereof is formed to have a relatively round shape when viewed from the front (as shown in FIG. 2). A window 5 is opened at a substantially central area of the surface of the upper half of the body 2.

The window 5 extends in a right and left direction in FIG. 2. A liquid crystal display (LCD) 6 is provided at the window 5. On a left side of the upper half of the body 2, a cutting lever 7 is provided. A thermal tape 9 that is printed and discharged from a tape discharging opening 8 (see FIG. 3) formed at an upper end of the tape printing device 1 can be cut by a cutter 10 (FIG. 6), which will be described later, by pressing the cutting lever 7 inwardly, with a thumb, for example.

A substantially lower half of the body 2 in the longitudinal direction thereof, which constitute a gripping portion 11, is formed to have a width slightly smaller than the width of the upper half of the body 2, and corners at right and left sides thereof are rounded so as to provide an easy grip. Further, corners at right and left sides of a portion of the back cover 3 corresponding to the gripping portion 11 are also rounded, which also provide an easy grip feel.

The back cover 3 attached to the body 2 is formed such that the thickness of the tape printing device 1 gradually decreases from a portion where a tape cassette 26 is accommodated toward the gripping portion 11. The gripping portion 11 is formed to have a thickness smaller than the thickness of the portion accommodating the tape cassette 26. The gripping portion 11 is configured so that a user can easily hold it in his/her hand. FIGS. 8 and 8A–8E show outlines of the cross sections of the body 2 with the back cover 3 attached thereto at various longitudinal positions of the tape printing device 1.

Various keys formed of soft rubber are provided on the front surface of the gripping portion 11. The keys include character input keys 12 for inputting alphanumerical characters and various symbols to create a text of document data, a space key 13 for entering a space, a case shift key 14 that carries out a case shift when it is pressed, a print key 15 for inputting a command instructing text printing, a cursor key 16 for moving a cursor to right and left on the LCD 6 that displays characters and symbols input through the character input keys 12, a power button 17 that is operated to power ON/OFF the tape printing device 1, and a return key 18 to be operated to select a letter selection or the like.

A plurality of characters are assigned to each of the plurality of character input keys 12. Thus, a character displayed on the LCD 6 changes among a plurality of characters when the same character input key 12 is repeatedly depressed.

Figure 5:
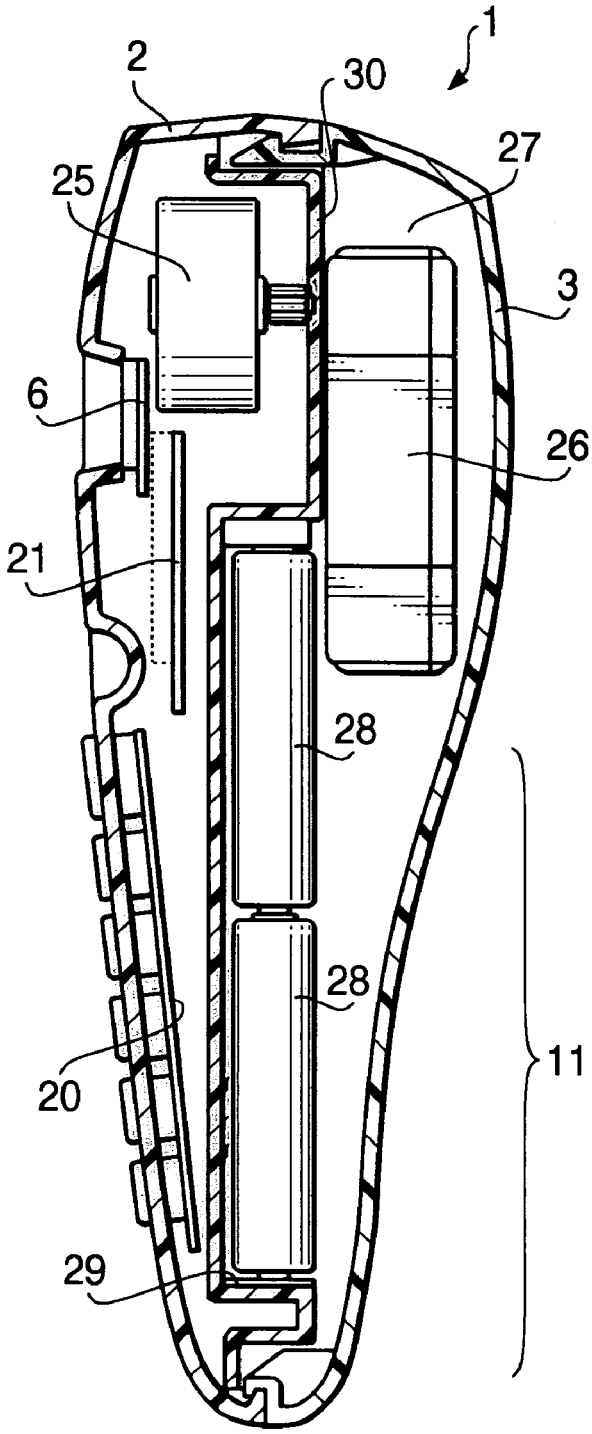
FIG. 5 is a cross sectional side view of the tape printing device according to the embodiment.
Figure 7:
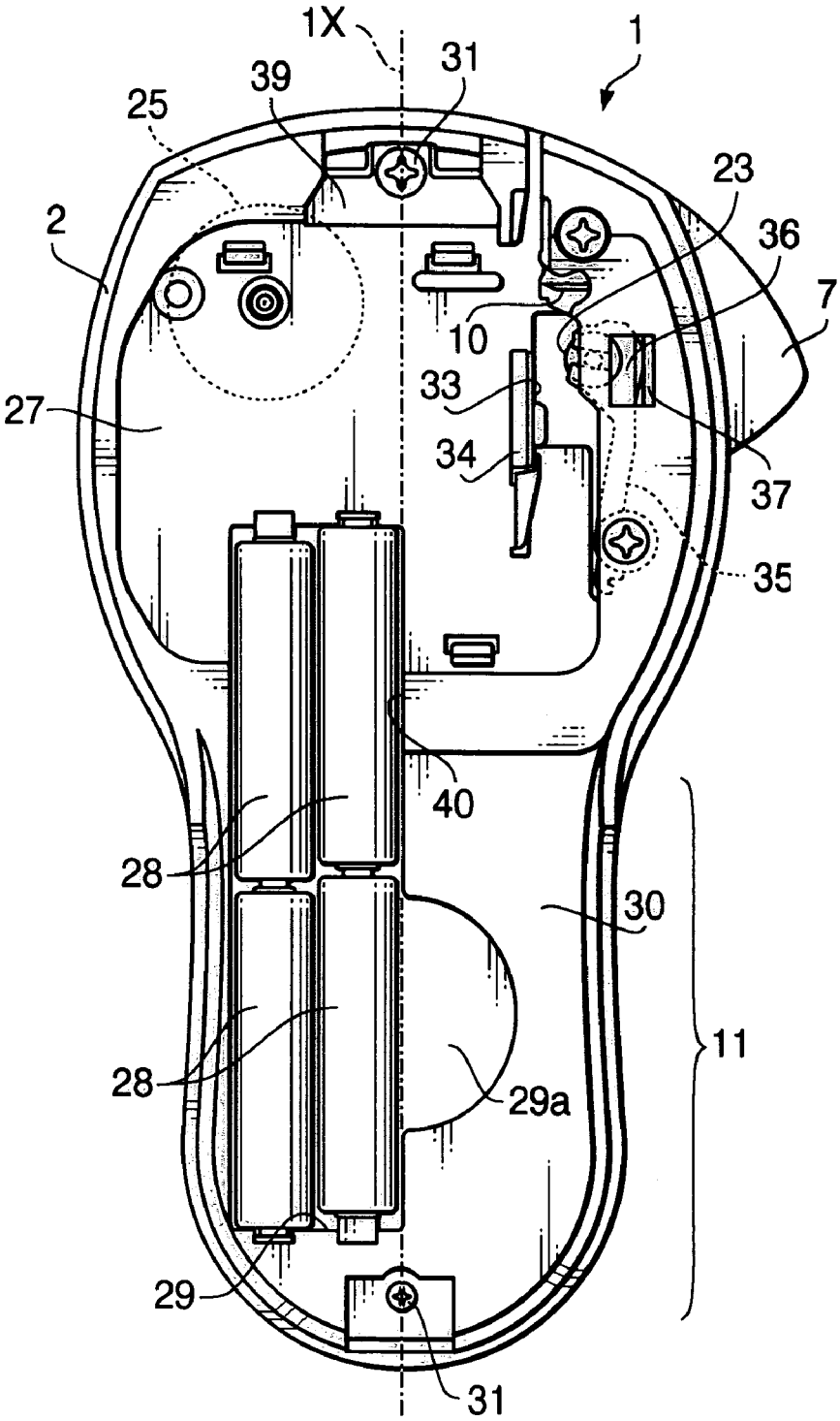
FIG. 7 is another rear view of the tape printing device with the back cover and the tape cassette being removed.

As shown in FIG. 5, a circuit board 20 is provided inside the gripping portion 11 of the body 2 below the front surface of the gripping portion 11. The character input keys 12, the space key 13, the case shift key 14, the print key 15, the cursor key 16, the power button 17, the return key 18 are arranged on a top surface of the circuit board 20. The control circuit board 21, on which a control circuit is provided, is disposed inside the body 2 at a position between the gripping portion 11 and the LCD 6. Further, a driving motor 25 is disposed in a space of the body 2 in a space that is defined on an opposite side of the control circuit board 21 with respect to a thermal head 33. As shown in FIGS. 5 and 7, the driving motor 25 is located at the upper end portion inside the body 2. The driving motor 25 is provided to rotatably drive a platen roller 23 via a not shown gear mechanism.

Figure 9:
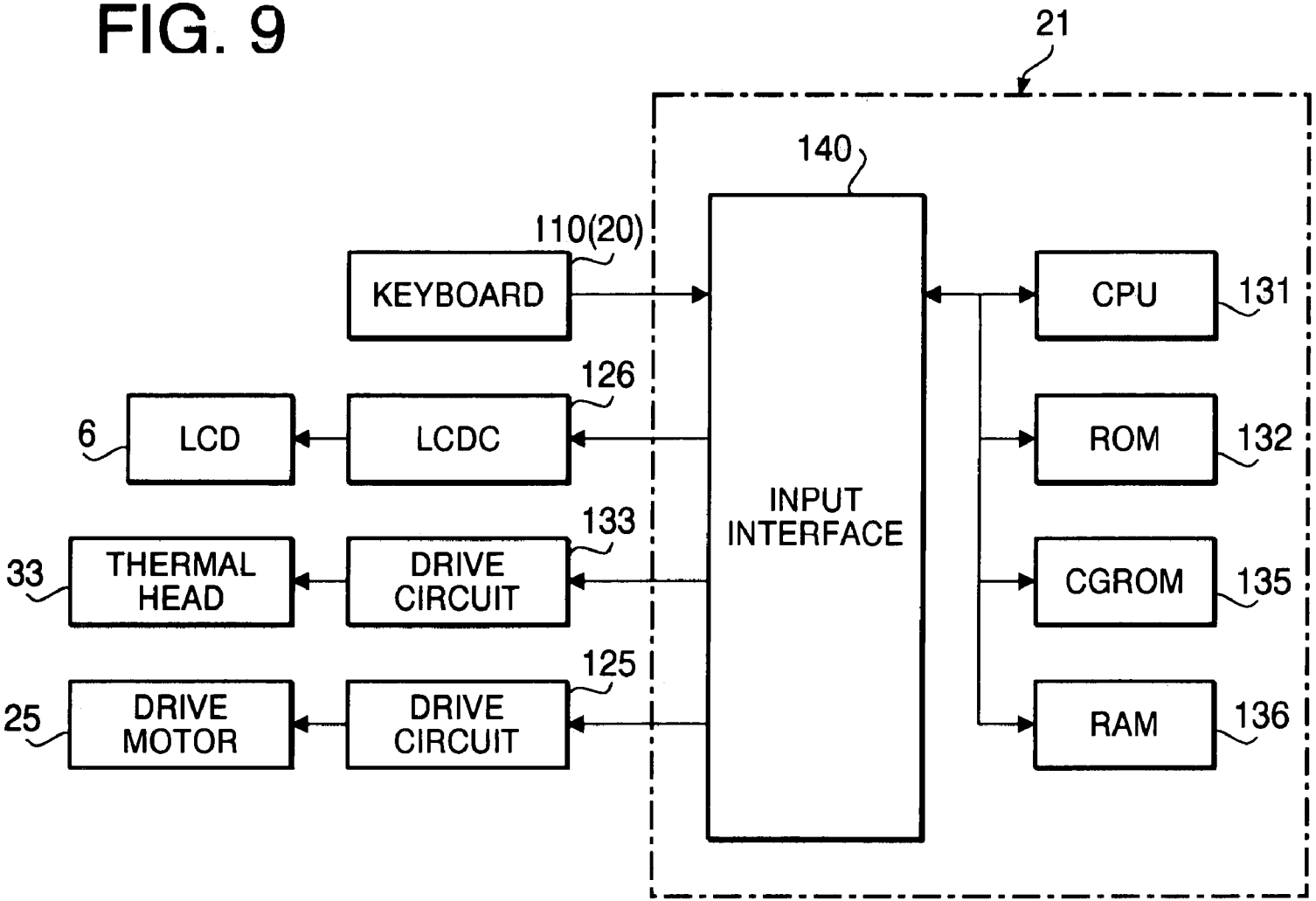
FIG. 9 is a block diagram of a control circuit of the tape printing device.

FIG. 9 shows a block diagram of the control circuit board 21 of the tape printing device 1 according to the embodiment. As shown in FIG. 9, the control circuit board 21 is provided with a CPU 131, a ROM 132, a RAM 136 and an input interface 140 which are interconnected with each other. The input interface is connected with a keyboard 110 (or, the circuit board 20) including the keys 12–18, the LCD 6 through an LCDC (Liquid Crystal Display Controller) 126, the thermal head 33 through a head driving circuit 133, and the driving motor 25 through a motor driving circuit 125. The LCDC 126, the head driving circuit 133 and the motor driving circuit 125 are also provided on the control circuit board 21.

The CPU 131 controls an entire operation of the tape printing device 1. The ROM 132 stores programs to be executed by the CPU 131. The RAM 136 is a volatile memory which provides a work area for temporarily storing data when the CPU 131 executes the programs stored in the ROM 132. The input interface 140 receives key input through the keys of the keyboard 110 (i.e., the circuit board 20). Further, the CPU 131 controls the LCDC 126 through the input interface 140 to control the LCD 6 to display characters/letters input through the character input keys 12 as well as operating status of the tape printing device 1. When the letters/characters are to be printed, the CPU 131 controls the head driving circuit 133 to drive the thermal head 33 to apply heat to the thermal tape 9 to form the letters/characters. Furthermore, the CPU 131 controls the motor driving circuit 125 to drive the driving motor 25 for feeding the thermal tape 9 for moving the thermal tape 9 relative to the thermal head 33 and for discharging the printed portion of the thermal tape 9 outside the tape printing device through the tape discharge opening 8.

Figure 10:
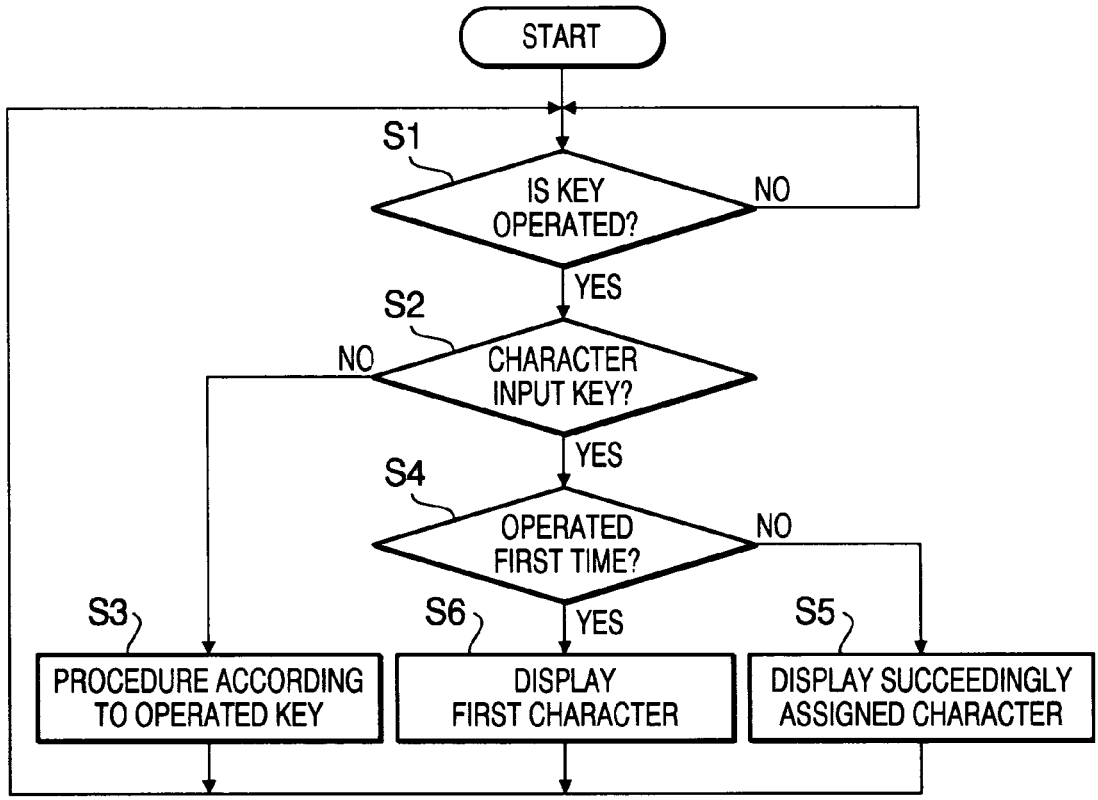
FIG. 10 is a flowchart illustrating a character input procedure.

FIG. 10 shows a flowchart illustrating a key input procedure to be executed by the CPU 131. Typically, the program is stored in the ROM 132 in the form of a computer program. According to the procedure, the CPU 131 determines whether one of the keys is depressed (S1). When none of the keys of the keyboard 110 is depressed (S1: NO), control repeats the determination. When a key is depressed (S1: YES), the CPU 131 determines whether the depressed key is a character input key 12. When a key other than the character input key 12 is depressed (S2: NO), control proceeds to S3, where a process corresponding to the operated key is executed (S3). When the character input key 12 is depressed (S2: YES), the CPU 131 determines whether the key is depressed first time at the present cursor position (S4). When the key is depressed first time (S4: YES), a predetermined one of the character assigned to the depressed character key 12 is displayed on the LCD 6 (S6), and control returns to S1. When the character input key 12 was previously depressed and it is determined that the depressed character input key 12 has been previously depressed at the same cursor position (S4: NO), a next character assigned to the character input key 12 is displayed on the LCD 6 (S5), thereafter control returns to S1.

For example, when one of the character input keys 12 having indications "a, b, c, 2" printed on the top surface thereof is depressed, the characters "a", "b", "c", and "2" are displayed cyclically, one by one, at a cursor position on the LCD 6 at each depression of the character input key 12. When the character input key 12 is depressed when the character "2" is displayed, "a" is displayed. The character displayed on the LCD 6 is entered when the return key 18 is depressed. Further, when the case shift key 14 is depressed, the case of the character displayed at the cursor position on the LCD 6 is switched between a lowercase and an uppercase. For example, when "a" is displayed at the cursor position of the LCD 6, by depressing the case shift key 14, the letter is changed to "A". Similarly, when the case shift key 14 is depressed, a letter "b" at the cursor position is switched to "B", or a letter "C" at the cursor position is switched to "c". The change is established when the return key 18 is depressed.

Figure 6:
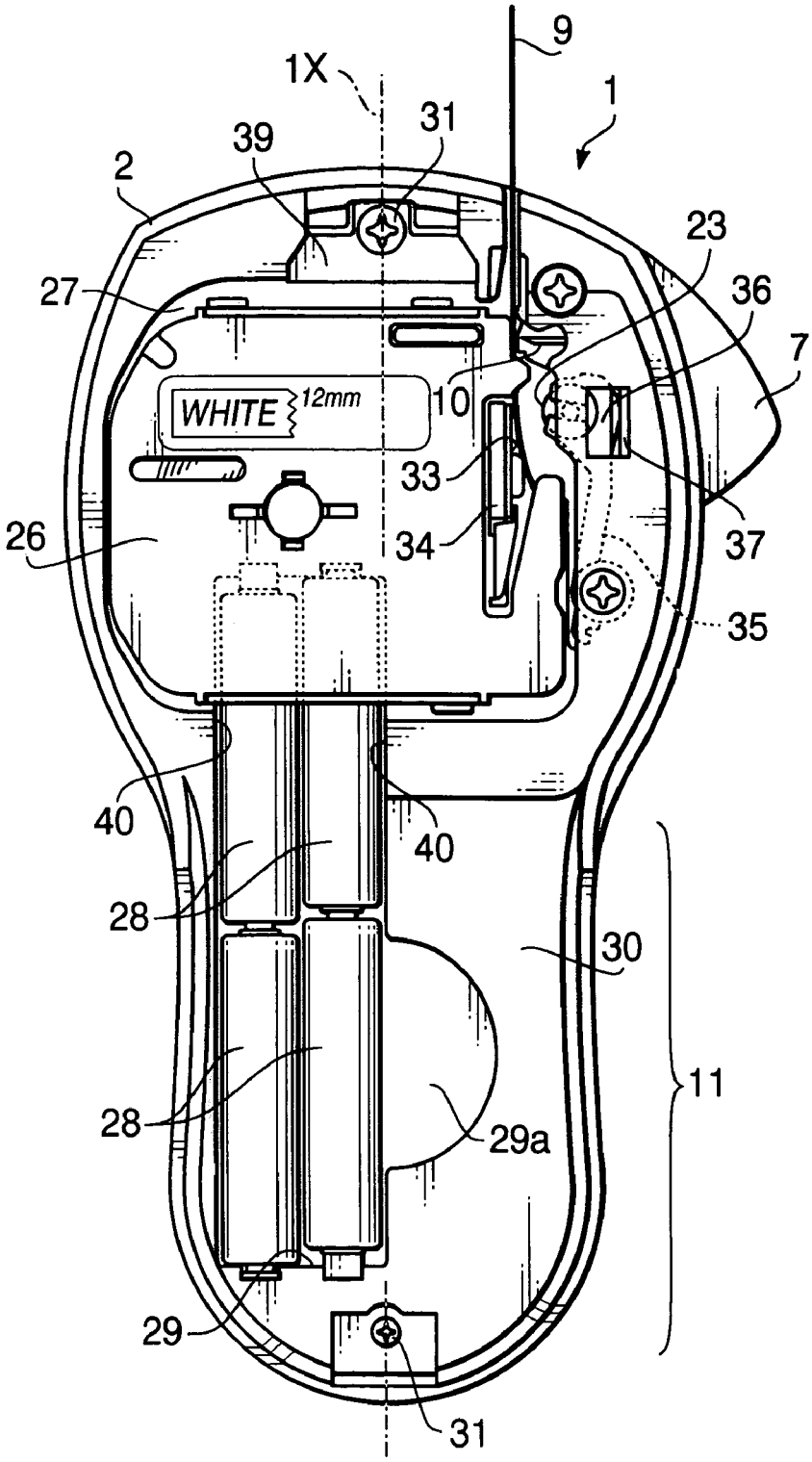
FIG. 6 is a rear view of the tape printing device with a back cover being removed and a tape cassette being attached.

As shown in FIGS. 5–7, a partition member 30 made of synthetic resign is fixed to the body 2 by means of screws 31 (see FIGS. 6 and 7) at an opening thereof defined behind the circuit board 20, the control circuit board 21, the LCD 6 and the driving motor 25. As will be described later, a cassette holding section 27 for receiving the tape cassette 26 (see FIGS. 5–7) and a battery holding section 29 that accommodates a plurality of batteries (four batteries in the present embodiment) with each two batteries arranged along the longitudinal direction of the body 2 (see FIGS. 6 and 7) are formed on a rear side of the partition member 30. The batteries supply electrical power to drive the thermal head 33, the driving motor 25 and the LCD 6. The partition member 30 is secured to the body 2 with screws 31 (see FIGS. 7 and 7).

Next, the structure of the partition member 30 will be described with reference to FIGS. 6 and 7.

Figure 7A:
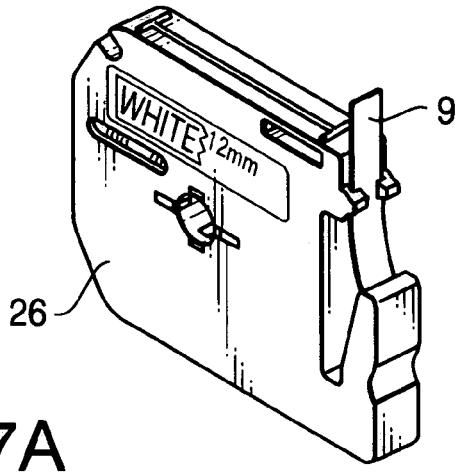
FIG. 7A is a perspective view of the tape cassette to be employed in the tape printing device according to the embodiment.
Figure 7B:
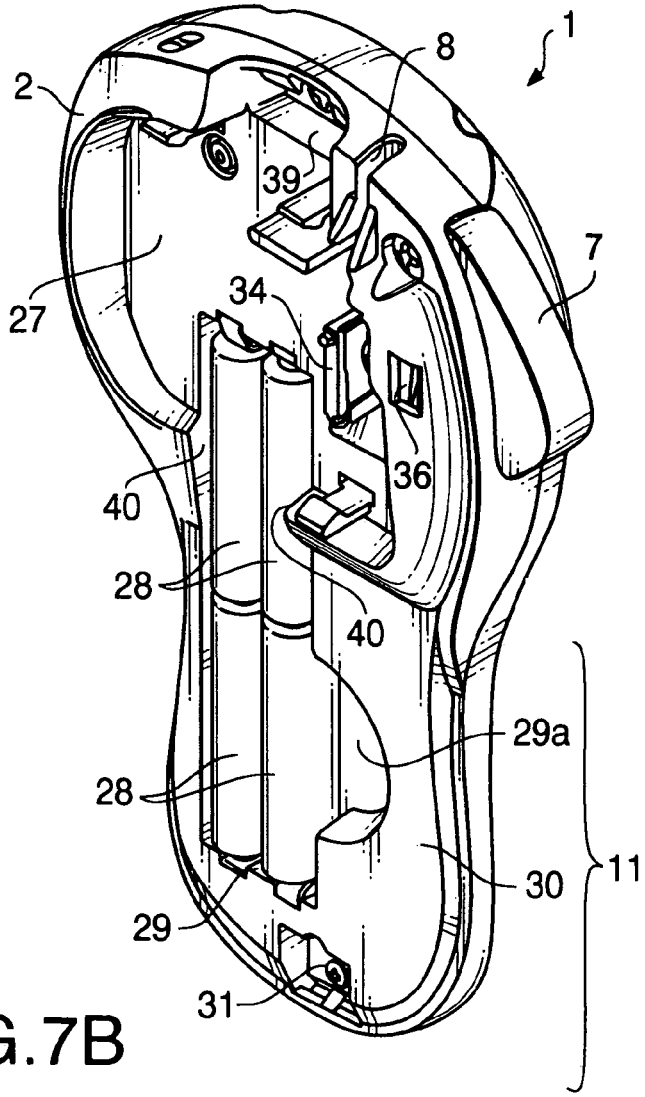
FIG. 7B is a perspective view of the tape printing device with the back cover being removed.
Figure 8:
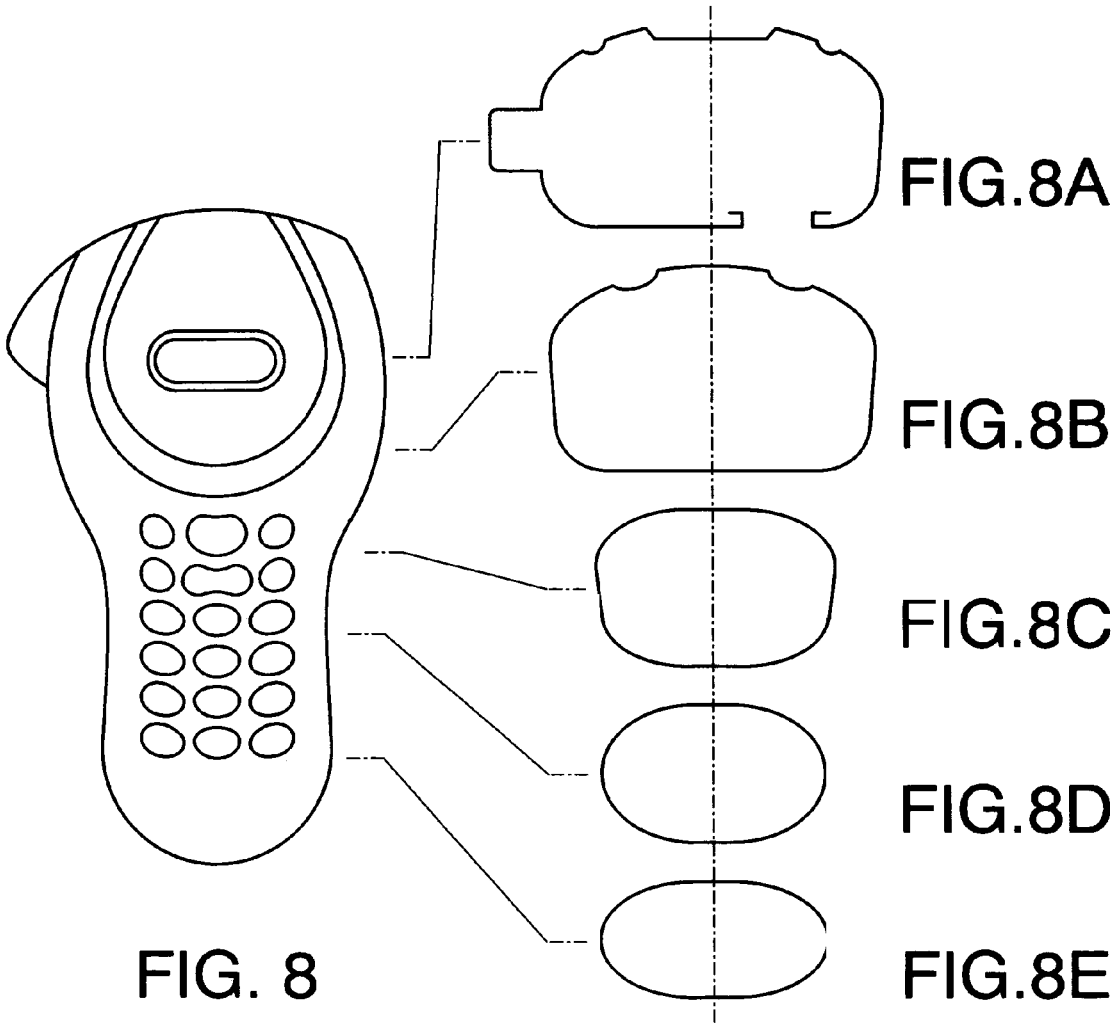

As shown in FIG. 6, the cassette holding section 27 is defined on the partition member 30 on the upper half in the longitudinal direction of the body 2. The cassette holding section 27 is formed to have a substantially rectangular shape viewed from the rear of the tape printing device 1 (as shown in FIGS. 6, 7 and 7B) that is substantially the same as the outside shape of the tape cassette 26, which is shown in FIG. 7A. Further, portions surrounding the cassette holding section 27 are formed to be protrude portions that protrude toward the back cover side of the tape printing device 1 so that the depth of the cassette holding section 27 with respect to the protruded portions is substantially the same as the thickness of the tape cassette 26 (see FIG. 7B).

On a bottom surface of the cassette holding section 27 at an end portion nearer to the cutting lever 7 (i.e., on the right-hand side end in FIG. 6, FIG. 7 or FIG. 7B), a thin plate-like thermal head mounting portion 34, on which the thermal head 33 is mounted, is provided. The thermal head mounting portion 34 is formed to extend along the longitudinal direction of the body 2, and stands perpendicularly (i.e., in a direction perpendicular to a plane of FIG. 6 or FIG. 7) from the bottom surface of the cassette holding section 27. The thermal head is mounted on the outer side (i.e., the tape cutter side) of the thermal head mounting portion 34.

A cutout is formed on a right-hand side portion (in FIG. 6) of the protruded potions defining the cassette holding section 27, at a portion facing the thermal head 33. A platen holder 35 is provided on the front-surface side of the partition member 30 at the cutout portion such that the platen holder 35 is swingable about an axis located at a lower end of the platen holder 35. The tape printing device 1 is configured such that, when the back cover 3 is detached from the body 2, the platen holder 35 is biased outward by a torsion spring (not shown), and located at a position (which will be referred to hereinafter as a "standby position") at which the platen holder 35 abuts a position fixing member 37 that is formed at an outward side (tape cutter side) of a substantially rectangular engaging hole 36 formed on the partition member 30, and extends toward the front surface of the tape printing device 1.

On the inner surface of the back cover 3, a protrusion (not shown) is formed at a position corresponding to the engaging hole 36. When the back cover 3 is attached to the body 2, the protrusion is inserted through the engaging hole 36, and interposed between the platen holder 35 and the position fixing member 37. With this structure, the platen holder 35 is rotated toward the thermal head 33 side until a portion of the thermal tape 9 is pressed to the thermal head 33 by the platen roller 23. The position of the platen holder 35 at this stage will be referred to as the operating position.

On an end of the rotation shaft of the platen roller 23, a gear is formed. When the platen holder 35 is located at the operating position, the gear is connected with a gear train that is connected to the driving motor 25. With this condition, when the driving motor 25 is driven to rotate, the driving force of the motor 25 is transmitted to the gear formed on the end of the rotation shaft of the platen roller 23, through the gear train, and the platen roller 23 is rotated, thereby the thermal tape 9 on which letter/characters are printed with the thermal head 33 is fed.

It should be noted that the thermal tape 9 accommodated in the tape cassette 26 is configured such that color is developed when heat is applied thereto by the thermal head 33. Thus, the thermal energy required for each heater element of the thermal head 33 can be kept lower than that in printing on a tape by a thermal ink ribbon, and the heating temperature of the thermal head can be suppressed at a lower level. Therefore, the creep deformation of the thermal head mounting portion 34 due to the heat generated by the thermal head 33 can be suppressed. Further, the thermal tape 9 may be one having an adhesive previously applied on the back side thereof and a release tape tentatively adhered on the adhesive layer.

As shown in FIGS. 6 and 7, the cutting lever 7 is biased by a not shown spring so that the cutting lever 7 neutrally biased to swing outward. The cutter 10 is slidably supported by a not shown cutter supporting mechanism, which also supports the cutting lever 7 slidably. In FIGS. 6 and 7, the cutter 10 is shown by partially breaking the partition member 30, and is located on the front surface side of the partition member 30 viewed from the rear side of the body 2. When the cutting lever 7 is pressed inward, the supporting mechanism moves the cutter 10 toward the tape cassette 26 and cuts the thermal tape 9 located thereat. A cutter supporting structure of the similar to the mechanism employed in the embodiment is disclosed in U.S. Pat. No. 5,839,840, teachings of which are incorporated herein by reference.

As shown in FIGS. 5 and 6, a first gap 39 large enough for inserting a finger is formed at a middle of an upper end side, in the longitudinal direction of the body 2, of the cassette holding section 27.

The battery holding section 29 is formed on a portion of the partition member 30, which is located in the gripping portion 11, at a side opposite to the thermal head 33 with respect to a longitudinal center line 1X (see FIG. 5), i.e., below the driving motor 25 in the longitudinal direction of the body 2. The battery holding section 29 has an elongated rectangular shape when observed from the rear of the body 2 as shown in FIG. 7 and accommodates four batteries 28 (which are size AA batteries in the present embodiment) with each two batteries 28 arranged and connected along the longitudinal direction of the body 2. The battery holding section 29 is formed such that it steps down, from the bottom of the cassette holding section 27, toward the front surface side (left-hand-side in FIG. 5) by a depth that is slightly larger than the diameter of the batteries 28. The battery holding section 29 extends in the longitudinal direction of the body 2 such that the upper end of the battery holding section 29 is located in the cassette holding section 27 by a predetermined length. Thus, a portion of the batteries 28 is located on the front surface side with respect to the tape cassette 26 when the batteries 28 and the tape cassette 26 are attached to the body 2. A portion of the cassette holding section 27 facing the battery holding section 29 is cut out to form a second gap 40 that allows a finger to be inserted above the batteries 28 held in the battery holding section 29 when the tape cassette 26 is detached from the cassette holding section 27. It should be noted that any type of finger clearances that allow user's fingers to grip the tape cassette 26 cay be adopted instead of or in addition to the first and second gaps 39 and 40.

A recess 29*a* is formed on a thermal head side (the left-hand side in FIG. 6 or FIG. 7) of the battery holding section 29 defined in the gripping portion 11. The recess 29*a* has a semicircular shape when observed from the rear side of the body 2, and a finger can be inserted thereinto. The bottom of the recess 29*a* is substantially at the same level of the bottom of the battery holding section 29. It should be noted that any type of a finger clearance which allows the user's finger to access the battery can be adopted instead of or in addition to the recess 29*a*.

When the back cover 3 is removed as shown in FIGS. 6 and 7, the platen holder 35 is located at the standby position and the tape cassette 26 can be taken out of the cassette holding section 27 by inserting fingers through the first gap 39 and the second gap 40. When the tape cassette 26 is removed from the cassette holding section 27, each battery 28 can be removed by inserting the finger through the recess 29*a,* and thus the batteries 28 can be exchanged. After the batteries 28 are exchanged, the tape cassette 26 is placed back in the cassette holding section 27 and the back cover 3 is attached on the body 2. When the back cover 3 is attached to the body 2, the platen holder 35 swings and is located at the operating position, thereby the tape printing device 1 being operable. It should be noted that the recess 29*a* is formed so as not to overlap the cassette holding section 27. Therefore, the batteries 28 can be exchanged without detaching the tape cassette 26.

Next, the operation of the tape printing device 1 will be described with reference to FIG. 4.

Figure 4:
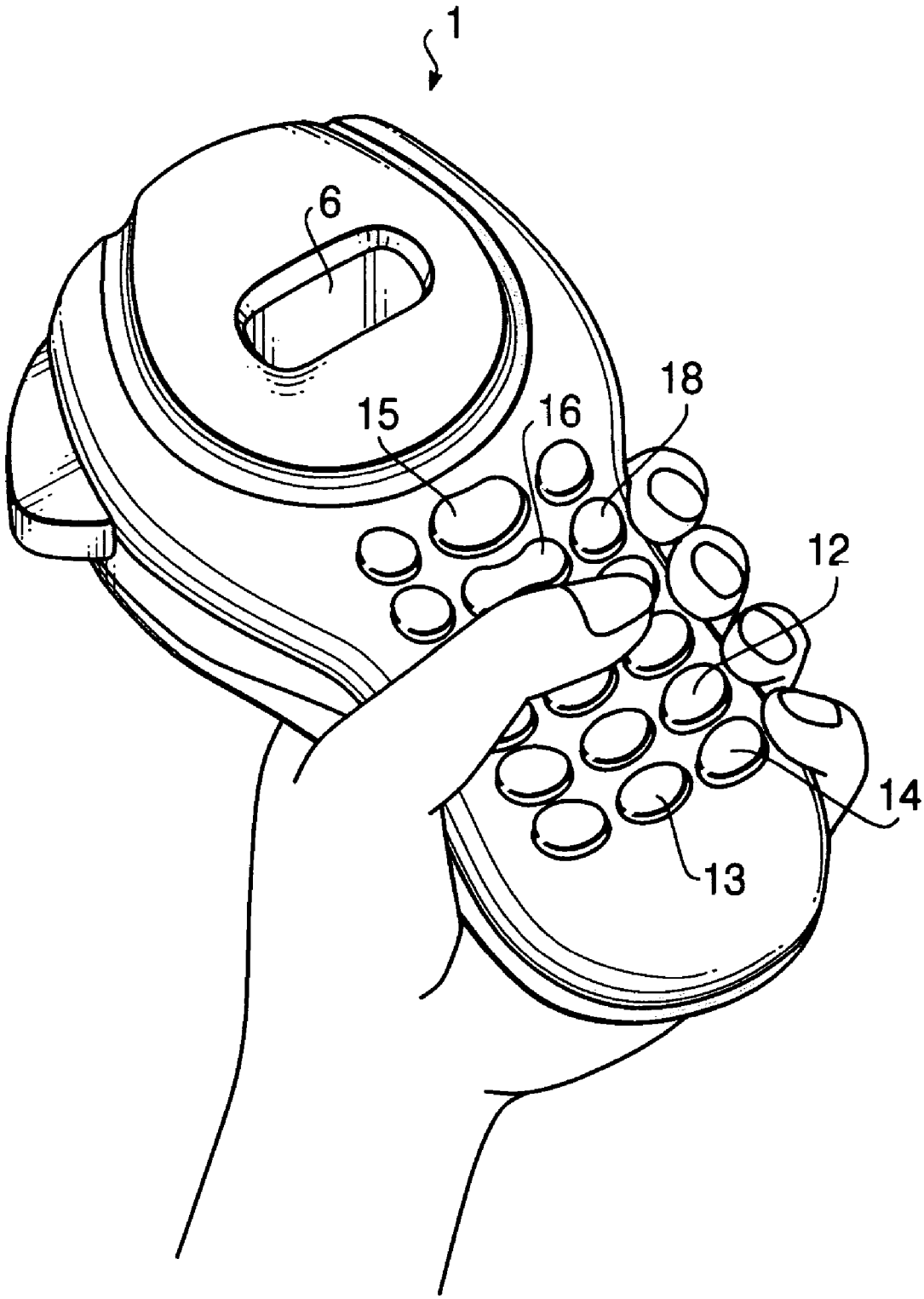
FIG. 4 is a perspective view showing the tape printing device held in a left hand of a user.

As shown in FIG. 4, the operator holds the gripping portion 11 of the tape printing device 1 by his/her left hand while making the LCD 6 display the printing data. The operator creates desired printing data with ease by pressing the character input keys 12, the space key 13, the case shift key 14, the cursor key 16, and the return key 18 by the thumb of the left hand, for example. When the print key 15 is pressed, the input data is printed on the thermal tape 9, which is discharged from the tape discharging opening 8 of the tape printing device 1. Then, the cutting lever 7 is pressed inward by the thumb of the left hand that holds the tape printing device 1, to cut the thermal tape 9 on which the desired printing data is printed and discharged from the tape discharging opening 8. Thus, the operator can obtain a tape on which arbitrary data is printed using only the left hand holding the gripping portion 11 of the tape printing device 1.

As described above, the tape printing device 1 is provided with the gripping portion 11 at a portion below the cassette holding section 27 in the longitudinal direction. The width of the gripping portion 11 is narrower than the upper half portion of the tape printing device 1. The user can use the tape printing device 1 by holding the gripping portion 11 and create a desired printed tape with ease irrespective of places and environments of use. Further, the battery holding section 29 is formed in an elongated shape so that it can accommodate two batteries arranged along the longitudinal direction of the body 2 (i.e., in the up-and-down direction in use). Further, the battery holding section 29 is formed in the gripping portion 11 such that the upper side thereof, in the longitudinal direction, overlaps the cassette holding section 27 by a predetermined length. Thus, the width of the gripping portion 11 can be reduced to a width that the user can grip with his/her hand easily, and the thickness of the gripping portion 11 can be increased to a thickness that the user can grip by his/her hand easily and comfortably. Thus, the user easily grips the gripping portion 11 with one hand and operates the tape printing device 1 with the hand holding the gripping portion 11. Further, since the battery holding section 29 is formed so that the upper side in the longitudinal direction of the battery holding section 29 overlaps the cassette holding section 27 by the predetermined length viewed from the rear of the tape printing device 1, the size of the gripping portion 11 in the longitudinal direction can be reduced, and hence the size of the tape printing device 1 in the longitudinal direction can be reduced.

Further, since the LCD 6 is arranged on the central area of the upper half portion of the body 2 corresponding to cassette holding section 27, and since a plurality of character input keys 12 and the like are arranged on the front surface of the gripping portion 11 located below the LCD 6 in the longitudinal direction of the body 2, the user can operate the character input keys 12 and other keys with the hand holding the gripping portion 11, while looking at the LCD 6. Thus, it is possible to create desired printed tape with ease by operating the tape printing device 1 with one hand.

Further, since each character input key 12 is configured so a plurality of characters are cyclically displayed on the LCD 6 at each operation of the same key, the number of the character input keys 12 can be reduced, and each character input keys 12 arranged on the front surface of the gripping portion 11 can be formed relatively large, and hence the user can easily operate the tape printing device 1 with one hand.

The driving motor 25 is disposed inside the upper side of the body 2, and the thermal head 33 and the platen holder 35 are disposed on the opposite side of the driving motor 25 with respect to the longitudinal center line 1X of the body 2. Thus, the gripping portion 11, in which the battery holding section 29 is formed, can be formed narrower so that it can be held easily with achieving an improved operability. Further, the driving motor 25 and the like, which have large weights, and the batteries 28, can be distributed along the longitudinal direction of the device body 2. Thus, the weight of the tape printing device 1 is well balanced when it is held in hand, and hence the operability when a printed tape is created can be improved.

Since the recess 29*a* for removing the batteries 28 is formed on the side portion of the battery holding section 29 on the thermal head 33 and the platen holder 35 side, the recess 29*a* can be formed to be sufficiently large in the width direction, which facilitates the removal of the batteries 28 from the battery holding section 29.

Both corners defined in the thickness direction of the right and left sides of gripping portion 11 is formed with smooth curves, and the tape printing device 1 is formed such that the thickness thereof gradually decreases from a portion corresponding to the cassette holding section 27 toward the upper part of the gripping portion 11. Thus, it is easy to hold the tape printing device 1 with one hand and the working efficiency can be improved.

The cassette holding section 27 is formed with the first gap 39 and the second gap 40 formed at the upper and lower sides thereof in the longitudinal direction of the device body. The first gap 39 and the second gap 40 allows the fingers to grip the tape cassette 26 when the tape cassette 26 is to be removed. Thus, the tape cassette 26 can be placed and removed with ease.

The second gap 40 formed at the lower side of the cassette holding section 27 in the longitudinal direction of the device body is formed such that it overlaps the upper side, in the longitudinal direction, of the battery holding section 29, viewed from the rear of the body 2. Thus, the mounting and removal of the batteries 28 can be carried out with ease by removing the tape cassette 26, and further reduction of the longitudinal size of the tape printing device 1 can be achieved with ease.

It should be noted that the present invention is not limited to the structure of the embodiment described above and various changes and modifications may be made without departing from the scope of the invention. For example, the tape printing device may be modified as follows.

In the embodiment describe above, four batteries 28 are directly placed in the battery holding section 29. However, each two of the four batteries may be longitudinally arranged and placed in a resin cases, and these cases may be placed in the battery holding section 29. By preparing a plurality of cases accommodating the batteries are placed and attaching/removing these frames to/from the battery holding section 29, the exchange of the batteries 28 can be carried out quickly.

Further, in the embodiment describe above, four batteries 28 are directly placed in the battery holding section 29. However, a secondary battery pack constituted by combining a plurality of rechargeable batteries such as Ni—Cd batteries may be accommodated in the battery holding section 29. With this configuration, the batteries to be accommodated in the battery holding section 29 can be recharged, resulting in lower cost of maintenance and resource saving.

As described above, the width of the gripping portion of the device body can be reduced and the thickness of the gripping portion of the device body can be increased, with allowing the user to hold it in hand with ease. The tape printing device allows users to grip the gripping portion and to operate the printing device easily with one hand. Further, since the battery holding section is formed such that the upper side thereof in the longitudinal direction overlaps the cassette holder by a predetermined length, the size of the gripping portion in the longitudinal direction can be easily reduced, and hence the size of the device body in the longitudinal direction can be easily reduced.

According to the tape printing device described above, the width of the gripping portion of the device body can be reduced and the thickness of the gripping portion of the device body can be increased so that the user can grip it with his/her hand easily and comfortably. Since the user can easily grip the gripping portion with one hand and operate the tape printing device, the operability is improved. Further, since the battery holder is formed such that an upper side in the longitudinal direction thereof overlaps the cassette holder by a predetermined length when viewed from the rear of the body, the size of the gripping portion in the longitudinal direction can be reduced, and hence the size of the device body in the longitudinal direction can be reduced.

According to the tape printing device described above, since the display is arranged on the front surface of the device body at a location corresponding to the cassette holding section, and since a plurality character input keys are arranged on the front surface of the gripping portion, which is below the display device in the longitudinal direction of the device body, the user can operate the character input keys with the hand that holds the gripping portion, while look at the display device and create a desired printed tape by operating the tape printing device with one hand.

According to the tape printing device described above, since each character input key is configured so that a plurality of characters are cyclically displayed on the display device upon operation of the same key, the number of the character input keys can be reduced, and each character input keys arranged on the front surface of the gripping portion can be formed relatively large. With this configuration, the user can easily operate the device with one hand and the operability can be improved.

According to the tape printing device described above, since the battery holding section is located on an opposite side of the thermal head with respect to a longitudinal center line of the device body, the battery holding section can be easily formed so that it overlaps the cassette holder when viewed from the rear of the body, and further reduction of the size of the device body in the longitudinal direction can be achieved with ease.

According to the tape printing device described above, since the driving motor is in the upper side of the device body in the thickness direction of the tape cassette, and above the battery holder in the longitudinal direction of the device body, the thermal head is disposed on the opposite side of the driving motor with respect to the longitudinal center line of the device body, and thus the width of the portion of the device body, inside which the battery holder is provided, can be reduced, and the gripping portion of the device body can be formed narrower so that it can be held more easily, with improving the operability. Further, the driving motor including a motor, which is a relatively heavy part, and other parts and the batteries can be distributed within the device body in the longitudinal direction of the device body. Thus, the weight of the device body is well balanced when it is held in a hand, and hence the operability in creating a printed tape can be improved.

Further, since the recess for removing batteries is formed at the side portion of the battery holding section defined on the thermal head side of the battery holder, the recess can be formed sufficiently large in the width direction of the device body, and the batteries can be removed from the battery holder with ease.

Furthermore, since both corners in the thickness direction of right and left sides of the gripping portion is formed with smooth curves, and the tape printing device is formed such that the thickness thereof gradually decreases from the portion corresponding to the cassette holder toward the upper portion of the back side of the gripping portion in the longitudinal direction of the device body, the gripping portion can be held with one hand easily, and the operability can be improved.

According to the tape printing device described above, since the cassette holder is formed with gaps at the upper and lower sides thereof in the longitudinal direction of the device body, the gaps allowing fingers to grip the tape cassette when the tape cassette is to be removed, the attachment and removal of the tape cassette can be performed with ease.

According to the tape printing device described above, since the gap formed at the lower side of the cassette holder in the longitudinal direction of the device body is formed to overlap the upper side of the battery holding section in a longitudinal direction thereof when viewed from the rear, the attachment and removal of the batteries can be performed easily by removing the tape cassette, and the size of the device body in the longitudinal direction can be further reduces with ease.

The present disclosure relates to the subject matter contained in Japanese Patent Application No. 2002-369509, filed on Dec. 20, 2002, which is expressly incorporated herein by reference in its entirety.

What is claimed is:

1. A tape printing device, comprising:

a device body having a thickness and extending in a longitudinal direction and in a width direction which is perpendicular to the longitudinal direction;

a cassette holding section formed in said device body on one end side portion in the longitudinal direction thereof to accommodate a tape cassette;

a printing system that prints characters and/or letters on a tape-form recording medium accommodated in said tape cassette;

a driving system that feeds said tape; and a battery holding section formed in said device body on the other end side portion in the longitudinal direction thereof to accommodate a plurality of batteries, at least two of said plurality of batteries being aligned end-to-end in the longitudinal direction of said device body, wherein said device body has a gripping portion formed on the other end side portion in the longitudinal direction, the width of the gripping portion of said device body being narrower than the width of said cassette holding section, and at least a part on the one end side, in the longitudinal direction of the device body, of said battery holding section overlaps at least a part on the other side of the cassette holding section, in the longitudinal direction of said device body.

2. The tape printing device according to claim 1, where the one end side portion is an upper end side portion of said device body when said tape printing device is in use.

3. The tape printing device according to claim 1, further comprising:

a display device disposed on a surface of the device body at a position corresponding to said cassette holding section; and a print data input system disposed on said device body surface at a portion on the other end side portion in the longitudinal direction of said device body with respect to said display device;

wherein said print data input system has a plurality of character input keys arranged on a surface of said gripping portion.

4. The tape printing device according to claim 3, wherein each of said character input keys is configured so that a plurality of characters is input one by one cyclically upon operation of said each of said character input key.

5. The tape printing device according to claim 1, wherein said battery holding section is formed closer to a one end side, in the width direction, of the device body.

6. The tape printing device according to claim 5, wherein a first finger clearance, through which a finger is inserted to pick up said batteries, is formed adjacent to said battery holding section, on the other end side, in the width direction, of said battery holding section.

7. The tape printing device according to claim 6, wherein said first finger clearance does not overlap said cassette holding section.

8. The tape printing device according to claim 1, wherein said battery holding section and said printing system are located on opposite sides, in the width direction, with respect to a longitudinal center line of said device body.

9. The tape printing device according to claim 8, wherein said driving system is disposed, inside said device body, on a front surface side in a thickness direction of said tape cassette, and on the one end side, in the longitudinal direction of the device body, of said battery holding section.

10. The tape printing device according to claim 9, wherein a first finger clearance, through which a finger is inserted to pick up said batteries, is formed adjacent to said battery holding section, on a print head side of said battery holding section in the width direction.

11. The tape printing device according to claim 1, wherein a tape discharging opening is formed on a side surface at the one end side, the tape-form recording medium being discharged through said discharging opening.

12. The tape printing device according to claim 1, wherein each of end sides of said gripping portion, in the width direction, is formed to be a smoothly curved surface such that both corners in a thickness direction thereof are rounded, and wherein a back side surface of said tape printing device is formed such that a thickness gradually decreases from a portion corresponding to said cassette holding section toward a portion corresponding to a part on the one end side, in a longitudinal direction, of said device body of said gripping portion.

13. The tape printing device according to claim 1, wherein said cassette holding section is formed with finger clearances at opposite sides along the longitudinal direction of the device body, said finger clearances allow fingers to grip the tape cassette attached to said cassette holding section.

14. A tape printing device, comprising:

a device body having a thickness and extending in a longitudinal direction and in a width direction which is perpendicular to the longitudinal direction;

a cassette holding section formed in said device body on one end side portion in the longitudinal direction thereof to accommodate a tape cassette;

a printing system that prints characters and/or letters on a tape-form recording medium accommodated in said tape cassette;

a driving system that feeds said tape; and a battery holding section formed in said device body on the other end side portion in the longitudinal direction thereof to accommodate a plurality of batteries, at least two of said plurality of batteries being aligned end-to-end in the longitudinal direction of said device body, wherein said device body has a gripping portion formed on the other end side portion in the longitudinal direction, the width of the gripping portion of said device body being narrower than the width of said cassette holding section, said cassette holding section is formed with finger clearances at opposite sides along the longitudinal direction of the device body, said finger clearances allow fingers to grip the tape cassette attached to said cassette holding section, and one of said finger clearance formed on the opposite sides of said cassette holder in the longitudinal direction of the device body is formed to overlap a part, on the one end side, of the battery holding section in a longitudinal direction thereof.

15. A tape printing device, comprising:

a device body having a thickness and extending in a longitudinal direction and in a width direction which is perpendicular to the longitudinal direction;

a cassette accommodating section formed in said device body on one end side portion in the longitudinal direction thereof;

a battery accommodating section formed in said device body on the other end side portion in the longitudinal direction thereof;

at least a part of said cassette accommodating section and at least a part of said battery accommodating section overlapping in the longitudinal direction of said device body.

16. The tape printing device according to claim 15, wherein a width of a portion of said device body corresponding to said battery accommodating section is smaller than a width of a portion of said device body corresponding to said cassette accommodating section.

17. The tape printing device according to claim 16, wherein a shape of said device body gradually changes from the portion corresponding to said battery accommodating section to the portion corresponding to said cassette accommodating section using a curved surface.

18. The tape printing device according to claim 15, wherein a thickness of a portion of said device body corresponding to said battery accommodating section is smaller than a thickness of a portion of said device body corresponding to said cassette holding section.

19. The tape printing device according to claim 18, wherein a shape of said device body gradually changes from the portion corresponding to said battery accommodating section to the portion corresponding to said cassette accommodating section using a curved surface.

20. The tape printing device according to claim 15, where the one end side portion is an upper end side portion of said device body when said tape printing device is in use.

21. The tape printing device according to claim 15, wherein said battery accommodating section is formed closer to a one end side, in the width direction, of said device body.

22. The tape printing device according to claim 21, wherein a first finger clearance, through which a finger is inserted to pick up a battery accommodated in said battery accommodating section, is formed adjacent to said battery accommodating section, on the other end side, in the width direction, of said battery accommodating section.

23. The tape printing device according to claim 22, wherein said first finger clearance does not overlap said cassette accommodating section.

24. The tape printing device according to claim 15, wherein a tape discharging opening is formed on a side surface at the one end side, a tape-form recording medium accommodated in said cassette being discharged through said discharging opening.

25. The tape printing device according to claim 24, further including a tape cutting mechanism including a lever manually operable by a user, the tape-form recording medium being cut out when the user operates said lever, said lever being provided on a side end surface, in the width direction, of said device body on the one end side portion.

* * * * *